US005127296A

United States Patent [19]

Held

[11] Patent Number: 5,127,296

[45] Date of Patent: Jul. 7, 1992

[54] DEVICE FOR HOLDING A CUTTING TOOL

[75] Inventor: Franz Held, Groβ-Zimmern, Fed. Rep. of Germany

[73] Assignee: Maschinenfabrik Goebel GmbH, Darmstadt, Fed. Rep. of Germany

[21] Appl. No.: 743,385

[22] PCT Filed: Jan. 18, 1991

[86] PCT No.: PCT/DE91/00035

§ 371 Date: Aug. 20, 1991

§ 102(e) Date: Aug. 20, 1991

[87] PCT Pub. No.: WO91/11303

PCT Pub. Date: Aug. 8, 1991

[30] Foreign Application Priority Data

Feb. 1, 1990 [DE] Fed. Rep. of Germany ..... 4002917

[51] Int. Cl.[5] ..... B26D 1/22; B26D 7/26

[52] U.S. Cl. ..... 83/505; 83/499; 83/508.003; 83/675

[58] Field of Search ..... 83/425.4, 498, 499, 83/500, 501, 502, 504, 505, 506, 507, 508.2, 508.3, 659, 675

[56] References Cited

U.S. PATENT DOCUMENTS

| | | | |
|---|---|---|---|
| 3,782,234 | 1/1974 | Rodach | 83/665 |
| 3,785,232 | 1/1974 | Frye et al. | 83/500 |
| 4,143,572 | 3/1979 | Schonmeier | 83/501 |
| 4,157,672 | 6/1979 | Frye | 83/500 |
| 4,189,967 | 2/1980 | Calvert | 83/675 |
| 4,233,869 | 11/1980 | Meyer et al. | 83/500 |
| 4,414,875 | 11/1983 | Pearson | 83/508.003 |
| 4,646,603 | 3/1987 | Held | 83/425.004 |
| 4,759,249 | 7/1988 | Held | 83/508.003 |

FOREIGN PATENT DOCUMENTS

| | | | |
|---|---|---|---|
| 1308902 | 9/1956 | Fed. Rep. of Germany . | |
| 1038902 | 9/1958 | Fed. Rep. of Germany . | |
| 2250125 | 4/1977 | Fed. Rep. of Germany . | |
| 3604701 | 9/1986 | Fed. Rep. of Germany . | |
| 84309 | 9/1935 | Sweden | 83/675 |

*Primary Examiner*—Hien H. Phan

*Attorney, Agent, or Firm*—Watson, Cole, Grindle & Watson

[57] ABSTRACT

The lower cutter of an apparatus for longitudinally slitting a continuous web is rotatably mounted about a support shaft extending perpendicular to a direction of formation of the web to be slit. The shaft is fixedly mounted on a machine frame, and the lower cutter is mounted on the shaft for movement to a desired setting position along the shaft.

6 Claims, 4 Drawing Sheets

4b
4a
4
38
34
9
8
13
35
36
7
39
33
12b
12a
37
12
32
13

DEVICE FOR HOLDING A CUTTING TOOL

BACKGROUND OF THE INVENTION

The invention related to the holding of a cutting tool, in particular a knife such as a bottom knife, which has at least two cutting edges. The bottom knife is coactable with at least one upper knife. At least one of the knives can be moved in such a manner that the upper knife can coact optionally with several cutting edges of the bottom knife. The bottom knife is rotatably mounted on a support shaft and is movable therealong to a desired setting position. The shaft is fixedly mounted on the machine frame and extends at right angles to the direction of formation of the web to be cut, the shaft extending through the bottom knife.

Devices of the aforementioned type having circular lower and upper knives or cutters are used in suitable machines to cut web-shaped materials. Usually a relatively wide web is cut with longitudinal cuts into relatively narrower individual webs if, for example, a roll of relatively wide web-shaped material is unwound and is then rewound into several rolls with respectively narrower width. To this end, socalled circular knives are used, where these cutting devices frequently consist of socalled upper and lower knives. The lower knives used in this case often comprise socalled cutting boxes, i.e. such lower knives, which have several cutting edges that are arranged coaxially to one another and with which an upper knife is coactable optionally with one of these cutting edges. The web-like material to be cut usually comprises paper, fabric, foils, metals or Plastics. However, other materials such as cardbord are also conceivable.

When cutting paper, fabric foil, metals or the like longitudinally, a distinction is made between the socalled straight cut and the socalled looped cut. During the straight cut, the web to be cut into individual strips travels through approximately tangentially between at least one upper and at least one lower knife, so that in this manner at least two strips are produced from one web. However, not only one pair of knives but also several pairs of knives, i.e. lower and upper knives respectively, can coact with one another, in order to cut a relatively wide web into a plurality of relatively narrow webs. The final processor of the web to be cut often desires webs of different width; for which reason there exists the demand to cut a relatively wide web during one production process, for example, into relatively wide webs, and during another, possibly subsequent production process into relatively narrow webs. As a rule these cut webs are wound into rolls, in order to be able, for example, to send these webs in an easy and convenient manner to the final processor. The changing demands of the final processor means for the person who has to divide a relatively wide web into individual webs that the device available to him must be correspondingly changed over; this process is commonly called "positioning". During a socalled straight cut it is relatively simple to position the lower and upper knife, since the web does not press against one of the two knives and thus impede its mobility. With the socalled looped cut, however, it is much more difficult to move the knife, i.e. as a rule the lower knife, around which the web is wrapped, since owing to the stress prevailing by necessity in the web for the purpose of Processing, the web presses against the lower knife. The lower knife is thus restricted in its mobility, for which reason it is mandatory especially in this case to provide that the lower knife moves with ease of motion when the position of this lower knife is to be changed.

German patent 10 38 902 discloses a known device in which several lower knives, i.e. socalled cutting boxes, are lined up in the axial direction side by side on a cylinder or a roller body serving as the guide for the cutting boxes. The cylinder can be rotated in a machine frame, the consequence of which is that, for example, at high speeds the bearings of the cylinder oscillate; these oscillations are transferred to the knives mounted on the cylinder and can lead to undesired cutting results, i.e., a poor cut, of the web to be cut. The lower knives of this prior patent can be moved by negligible amounts in the axial direction, but only when the lower knives are moved by hand with respect to the guide supporting them. Since the lower knives are relatively large and thus heavy, it is difficult and time consuming to bring these lower knives to an accurately predetermined position, a process that is also rendered more difficult by the frictional forces that are generated. In this manner it becomes difficult and time-consuming to align the lower and upper knives in such a manner against one another with this prior art device that they interact well and yield a predetermined width of the strip to be cut.

In the device according to published German application 36 04 701 the bottom and upper knives are mounted in separate carriages, the carriages being movable on separate guides. This construction is quite complicated and requires a lot of space. Due to the great distances between its components, it is also sensitive to oscillations.

The same also applies correspondingly to the device of U.S. Pat. No. 4,233,889 in which the knives are also mounted in a revolver, whose mounting also does not provide for a stable and precision balanced structure.

A cutting device is also disclosed in German Patent No. 22 50 125 wherein tension mechanisms are assigned to each knife in order to bring such knife to the desired position. However, this prior art device also requires a lot of space and is thus expensive and sensitive to oscillations.

In addition, U.S. Pat. No. 4,759,249 discloses a device which makes it possible to easily move the knives with respect to the shaft supporting them. However, this shaft is mounted in a machine frame, i.e., with bearings that are far apart from one another.

U.S. Pat. No. 4,646,603 discloses another device which makes it possible to easily move the knives with respect to the shaft supporting them. However, in this case the invention involves a mechanical action which requires grooves machined into the supporting shaft. These grooves can have a negative impact on the stability of the supporting device or require larger dimensions to obtain identical stability.

A mounting for a socalled upper knife is disclosed in U.S. Pat. No. 4,143,572. However, such upper knives are very easily compared to bottom knives, which contain at least two usable cutting edges, thus are socalled cutting boxes. Such cutting boxes are quite heavy, especially when they have a relatively large diameter. With respect to the mobility of the upper and lower knives the problem is totally different, so that no suggestion regarding how to move the lower knives efficiently can be derived from the patent.

A device to fix in position the knives on a shaft supporting them is disclosed in U.S. Patent No. 4,189,967.

However, here the problem is to produce a tight seat, but it does not involve the problem of being able to move such knives rapidly and simply.

SUMMARY OF THE INVENTION

Thus, in the present invention the object is to provide an inexpensive, stable, and oscillation insensitive guide for movable circular knives, in particular lower knives.

The problem is solved by the provision of the following features individually or in any combination with a non-rotatable guide in the form of a support shaft attached to the machine frame; a box in the form of a sleeve located between shaft and the lower knife; at least one bearing exhibiting radial forces and located between the sleeve and the lower knife; and a moveable subassembly comprising the sleeve, the bearing and the lower knife. The device also has at least one setting mechanism which is associated with the shaft and which is connected effectively to at least one of the lower knives. The sleeve covers a channel for the supply of pressure medium at any possible setting of the respective lower knife relative to the shaft. Axial grooves may be provided in the shaft periphery and setting mechanism embedded in these grooves, where each box is connected to a setting mechanism. Several such subassemblies may be respectively interconnected by at least one coupling, which is located between the faces of adjacent lower knives and which interacts with such faces. A drive is connected effectively to at least one of the lower knives in order to rotate such lower knife. A tension or pressure medium may be provided as the setting mechanism. And, the bearing can be a roller bearing in the radial direction.

Accordingly, the circular knives of the invention—especially the lower knives—and here in turn the cutting box subassemblies—, can be moved easily and simply—also automatically—to any desired position, wherein the device is stable, low in cost and oscillates negligibly. Furthermore, the device is also suitable for circular knives with large diameters, i.e. also for heavy circular knives.

In addition, the boxes or subassemblies can also be moved from outside the machine, for example, from outside its side wall, to the correct position, a feature that enables easy control. A device for the socalled straight and especially also for the looped cut can also be used when the circular knives are pressed very close together. In addition, a delicately sensitive setting, i.e. positioning of the respective cutting knives is possible.

Other features and advantages follow from the following description of two embodiments. The individual features can be realized one at a time for themselves or in several arbitrary combinations into other embodiments of the invention. With the disclosed embodiments, which are shown as schematic drawings in the accompanying Figures but which do not restrict the invention, the invention will be described in detail. The embodiments can be changed in various ways without affecting the scope of the invention. In the Figures those machine parts that are nonessential in the present context and sufficiently known to the artism are not shown for the sake of a straightforward presentation. Rather the Figures show only those parts that are necessary for the detailed esxplanation of the invention and its advantages.

DETAILED DESCRIPTION OF THE INVENTION

Figure 1:
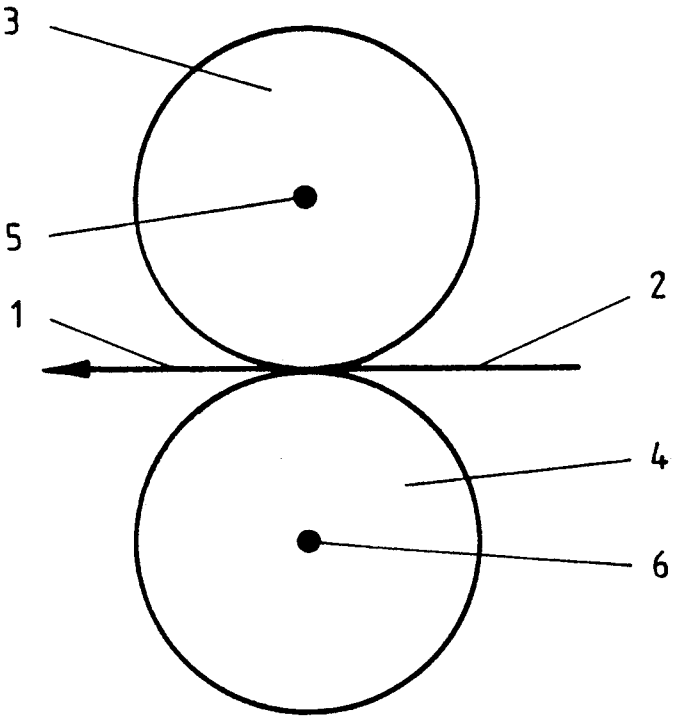
FIG. 1 is a schematic drawing of the socalled straight cut.

In the device according to FIG. 1, a web 2 to be cut into several strips 1 travels through at least one pair of knives. In the viewing direction of the Figure an arbitrary number of pairs of knives can be arranged in succession. Each pair of knives comprises an upper knife 3 and at least one lower knife 4; the upper knife/knives 3 is/are mounted on a shaft or guide 5, whereas the lower knife/knives 4 is/are mounted on a shaft or guide 6. If they are shafts, then each of the shafts 5 or 6 can be generally rotated in a suitably designed machine frame and can also be driven. For the sake of changing their position, i.e., the width of the strips 1 to be cut, the upper knives 3 can be moved, as the occasion demands, along the shaft 5—thus in the viewing direction of FIG. 1—and the lower knives 4 along the shaft 6. This shaft can be relatively small, especially when there are several cutting points per lower knife. For example, the lower knife can be designed as socalled cutting boxes, where each cutting box has a plurality of cutting edges. With each of these edges one and the same upper knife can coact by choice so that frequently when changing the format it is necessary to move the upper knife by a relatively long axial distance, but the lower knife by only a very much shorter distance, in order in this manner to make it possible that the upper knife can coact with another cutting edge, a socalled cutting groove or the like than before.

Figure 2:
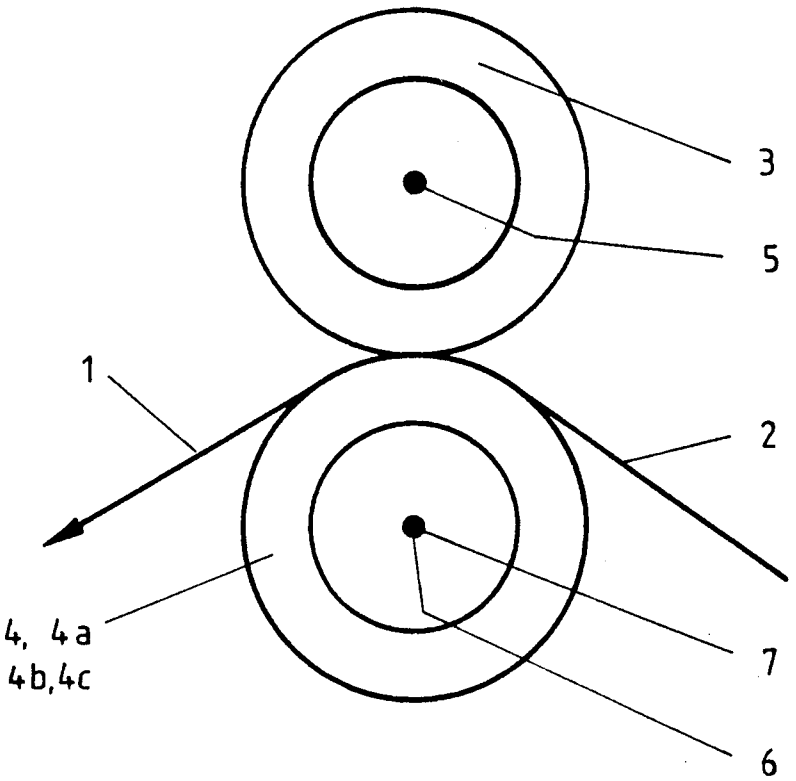
FIG. 2 is a schematic drawing of the socalled looped cut.

If is apparent from FIG. 2 that the web 2 and the strips 1 cut from said web partially envelop the lower knife/knives 4. In this manner the web to be cut during the cutting operation is held better than in the case of the socalled straight cut according to FIG. 1. When in the case of the socalled looped cut according to FIG. 2 the lower knives 4 must be moved in the axial direction of the shaft 6. Due due to the mechanical tension inherent in the web and the strips, the web 2 to be cut and the strips 1 cut from the web press the lower knife/knives 4, whose weight must not be neglected, especially when it involves socalled cutting boxes, against the shaft 6, supporting the lower knife/knives, and thus prevent the lower knives 4 from being moved in the axial direction of the shaft 6, i.e., in the viewing direction of FIG. 2.

Figure 3:
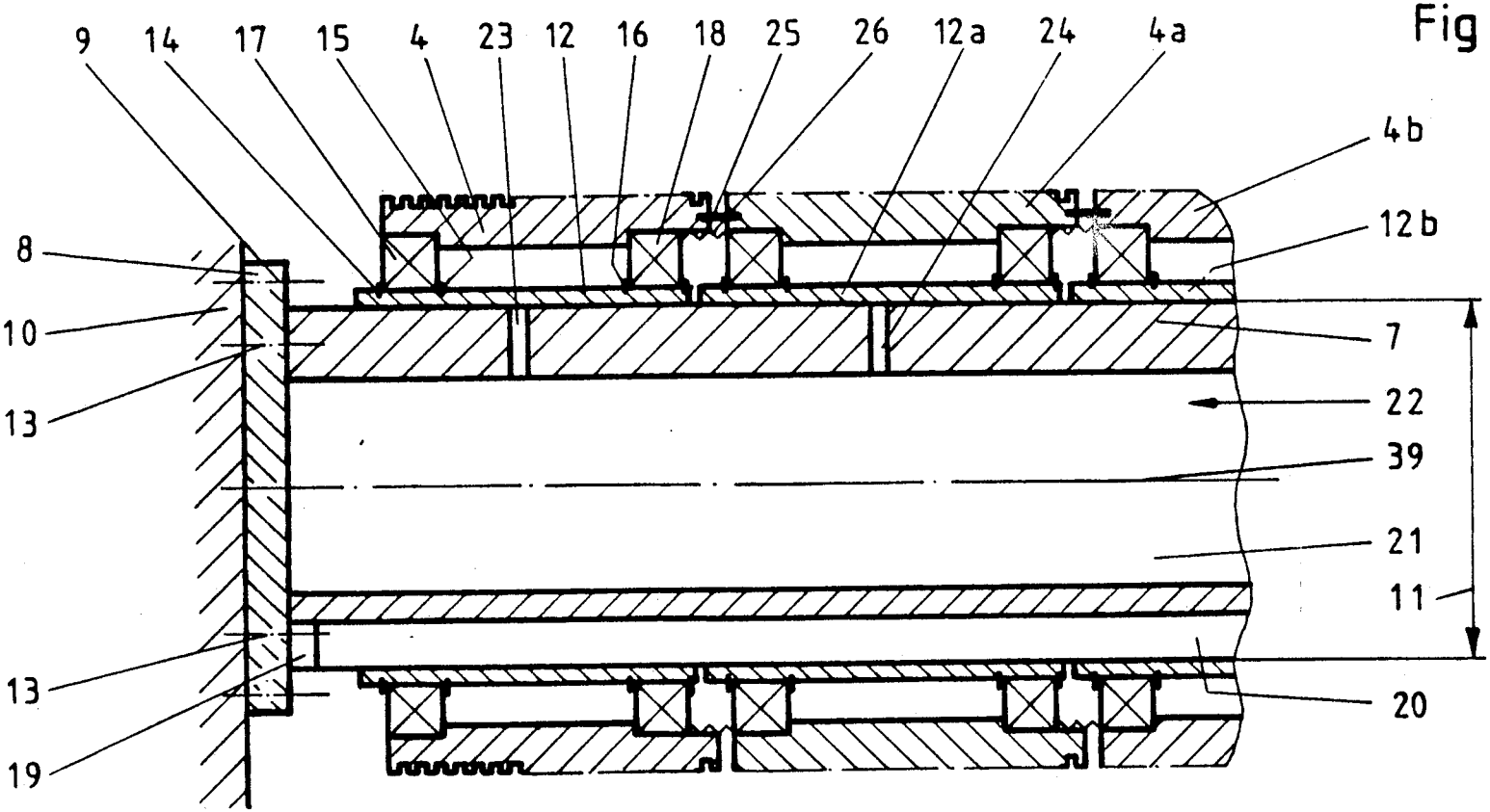
FIG. 3 is a sectional view of a guide or support shaft for supporting and holding a lower knife according to a first embodiment.

It is apparent from FIG. 3 that the cutting boxes, for example the cutting boxes 4, **4*a*, and 4*b* which form subassemblies, are not supported in the conventional manner by means of a rotatable shaft but rather by a stationary, non-rotatable guide or support shaft 7. The guide 7 is provided with at least one flange 8, which is securely connected with screws 9 to the frame 10 of the machine. Since there is a screw connection here, it is possible to remove the guide 7 with everything held by it and mounted on it completely from the machine. For example, this kind of attachment can become necessary when the guide 7 is to be provided with lower knives that have not yet been used, i.e. for example, when other lower knives were to have become unusable due to a prolonged cutting operation. It is also apparent from FIG. 3 that by the provision of the screw connection 9 the guide 7, which can be straight or also slightly bent, cannot be rotated in the machine frame 10. Apart from the flange 8, the outer contour of the guide 7 is preferably cylindrical, as indicated by the diameter 11. In this manner it is possible to slip the boxes or sleeves, for example the boxes or sleeves 12, 12***a*, and 12*b* with coaxial cylindrical outer and inner surfaces on the guide 7. This is made possible in Particular due to the fact that the flange 8 and the guide 7 can be connected together by a detachable screw connection 13. In each of the boxes 12 are machined grooves, which are intended to hold retaining rings, for example the retaining rings 14, 15 and 16. These retaining rings serve to attach bearings, especially roller bearings, which can also absorb axial forces, as such roller bearings 17 and 18, on the box 12. The roller bearings 17 and 18 in turn extend into appropriate recesses of the bottom knives 4, so that in this manner a reciprocal displacement of the respective lower knife 4, respective roller bearing 17 and 18 and the respective box 123 is not possible, so that in this manner a subassembly is produced that comprises the respective box or sleeve 12, the respective bearings 17 and 18 and the respective lower knife 4. In this manner at least one bearing 17 and/or 18 bearing radial forces is arranged between the box 12 and the respective lower knife 4, which is, for example, a socalled cutting box. The conditions at the other lower knives, which are also lined up on guide 7 such as lower knives 4*a* and 4*a* and possibly other lower knives lined up on guide 7, are analogous to the conditions at the lower knife 4.

In the embodiment according to FIG. 3 at least one groove 19 that is open outwardly is provided in the circular surface of the guide 7 indicated by the diameter 11, where into each of these grooves at least one hose 20 is inserted. This hose can be expanded, as the occasion demands, with a pressure medium, so that the respective box and/or all boxes 12 can be securely held with respect to the guide in its axial position, so that they cannot be displaced.

Furthermore, in the embodiment according to FIG. 3 a channel 21, into which according to the direction of the arrow 22 pressure medium such as compressed air can be admitted, is provided in the guide 7. The channel 21 is connected to radial branch channels 23 and 24, where each branch channel opens below a box 12, and in particular in such a manner that the respective branch channel is covered by the box 12 even when the box 12 and thus the respective lower knife 4 are to be moved by smaller amounts in the axial direction of the guide 7. In this manner an air cushion is inserted between the guide 7 and the respective box 12, such air cushion making it possible to move the respective lower knife 4 easily and thus to move the axial position of the lower knife 4 with respect to the guide 7, but which is the majority of all conceivable cases simultaneougly means moving the position of the lower knife 4 with respect to the upper knife coacting with the lower knife.

Adjacent lower knives such as the lower knives 4 and 4*a* are connected together by means of a coupling, which in the simplest case can occur in that a clip 25 extends tightly into one of the two faces of the two lower knives and extends so as to be moveable into the other face. In this manner a simple coupling is provided that allows all lower knives to be connected together in such a manner that all lower knives can be subjected to a rotary motion when one of the lower knives is provided with a rotary drive and in so doing allows a reciprocal displacement of the lower knives. At the same time an accordion-like seal 26 is provided between the faces of the adjacent lower knives, for example lower knives 4 and 4*a*; by means of such seal the dust collecting during the cutting operation and/or other contaminations are to be kept away from the lower knives, in particular their bearings.

Figure 5:
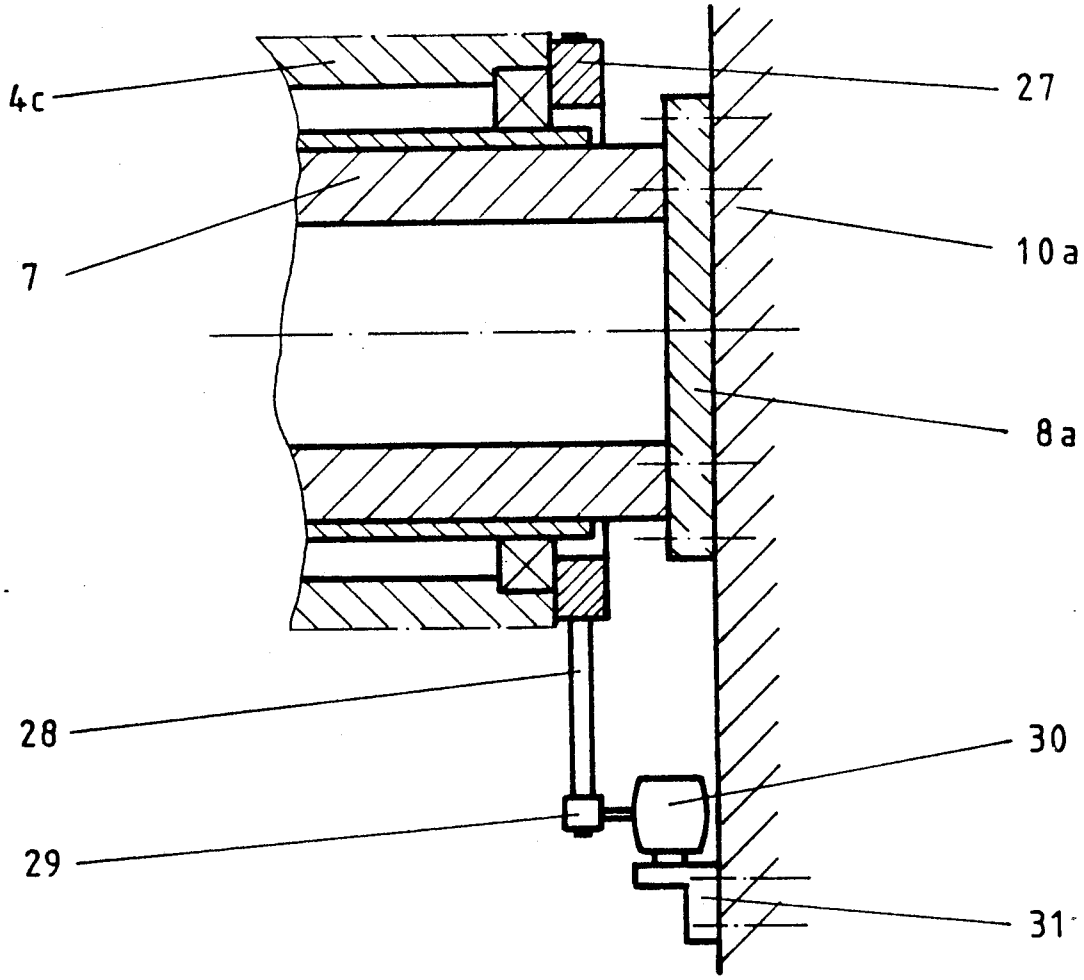
FIG. 5 shows a drive of the knives for the embodiments of FIGS. 3 and 4.

A drive for the lower knives is shown in FIG. 5. Here, for example, the lower knife 4*c* is connected to its two faces with a belt pulley 27, over which a flat or toother belt, a loop belt, a chain, a V belt or the like 28 is placed. The belt 28 travels over another belt pulley 29, which is connected to a motor 30 and is driven by the motor. The motor 30 is braced by means of a bracket 31 at a part 10*a* of the frame 10, just like flange 8*a* of the guide 7 which is analogous to flange 8. Instead of driving lower knives 4 shown in FIG. 5, any other drive that is suitable in the present context is also suitable, as long as it makes it possible to bring the bottom knife to a circumferential speed that is suitable for the cutting operation. This circumferential spped can be identical, for example, to the speed of the web to be cut.

Figure 4:
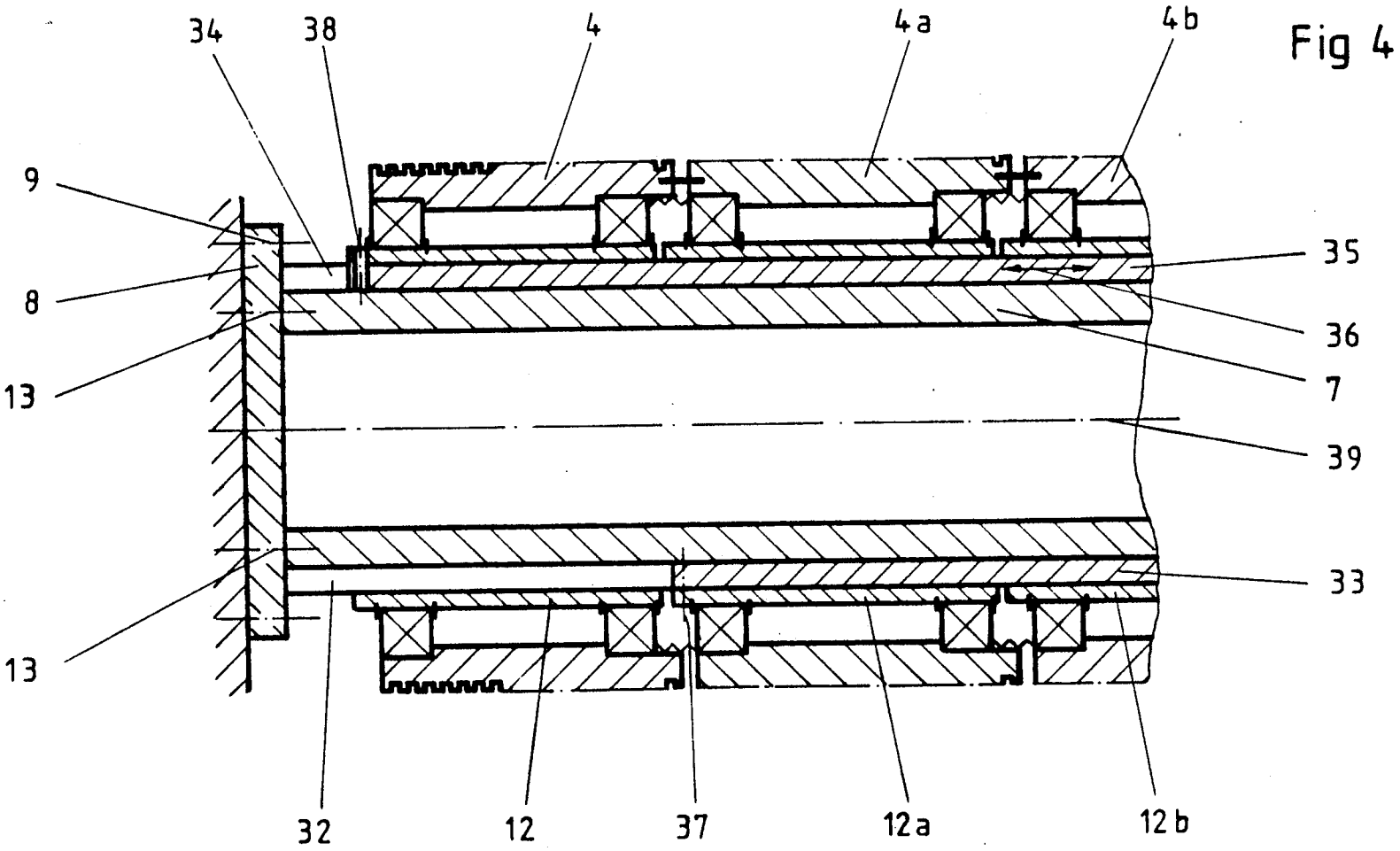
FIG. 4 shows another embodiment analogous to FIG. 3.

The embodiment of FIG. 4 differs from the embodiment of FIG. 3 in that, instead of only one groove 19, several grooves can be provided in the guide 7, where in the circumferential direction of guide 7 these grooves are spaced preferably at equal intervals or identical angles. At least one tension or pressure medium is embedded as a means to set or move the lower knives 4 into each of the grooves. For example, an adjusting rod 33 is embedded into groove 32 and an adjusting rod 35 is embedded into groove 34. One end of these adjusting rods is provided with thread and engages with a nut. By rotating the nut the adjusting rods can be moved in such a manner in the direction of arrow 36 that the axial position of the respective lower knife can be set and thus changed to a desired value. To this end, the adjusting rod 33 is connected, for example, to the box 12*a* with the aid of a pin or a screw 37. The adjusting rod 35 is connectedto the box 12 with the aid of a pin or a screw 38. Other analogous adjusting rods are assigned to the other boxes of the other lower knives. All adjusting rods are essentially parallel to the center line 39, which can be straight or slightly bent, embedded in the guide 7 and can be moved parallel to this center line, as the occasion demands. Instead of rigid adjusting rods, it is also possible to use elastic adjusting rods or other elastic tension or pressure members such as flexible plastic rods, rods made of glass fiber, chains, wire ropes or plastic ropes, provided they are suitable for changing the respective position of the respective lower knife with respect to the guide 7, i.e. essentially parallel to the center line 39. The lower knives 4 of the embodiment according to FIG. 4 can be set rotating, for example, by a drive according to FIG. 5, so that they obtain a circumferential speed that is optimal for the cutting operation, for example, equal to the speed of travel of the web to be cut. However, any other drive is also possible.

I claim:

1. In an apparatus for longitudunally slitting a continuous web, comprising a lower cutting means, a support shaft extending perpendicular to a direction of travel of the web to be slit, said cutting means being rotatably mounted about said shaft and said shaft being fixedly mounted on a machine frame, said cutting means comprising at least one cutting box subassembly mounted on said shaft for movement to a desired position therealong, said subassembly comprising a cylindrical cutter having a plurality of cutting grooves presenting a series of spaced cutting edges, a sleeve mounted about said shaft beneath said cutter, and anti-friction bearings located between said sleeve and said cutter.

2. In the apparatus according to claim 1, wherein means associated with said shaft are provided for setting said subassembly in said desired position along said shaft.

3. In the apparatus according to claim 1, wherein said shaft has a coaxial channel and a radial branch channel covered by said sleeve and opening into said coaxial channel, said channels being subjected to a pressure medium such as compressed air for effecting an air cushion between said sleeve and said shaft to facilitate the setting movement of said subassembly.

4. In the apparatus according to claim 2, wherein said shaft has at least one open axial groove provided in the outer periphery thereof, said setting means including a rod extending along said groove and connected to said sleeve of said subassembly.

5. In the apparatus according to claim 1, wherein said cutting means comprises a plurality of said cutting box subassemblies mounted on said shaft for movement to said desired position, and couplings provided for interconnecting said cutters of said subassemblies together.

6. In the apparatus according to claim 1, further comprising drive means connected to said cutting means for rotating said cutting means about said support shaft.

* * * * *